US005127324A

United States Patent [19]

Palmatier et al.

[11] Patent Number: 5,127,324

[45] Date of Patent: Jul. 7, 1992

[54] ADJUSTMENT APPARATUS WITH DC DRIVE SYSTEM FOR USE IN A PRINTING PRESS

[75] Inventors: Ronald T. Palmatier, Durham; Glenn A. Guaraldi, Kingston, both of N.H.

[73] Assignee: Heidelberg Harris GmbH, Dover, N.H.

[21] Appl. No.: 609,706

[22] Filed: Nov. 6, 1990

[51] Int. Cl.[5] ..... B41F 13/34

[52] U.S. Cl. ..... 101/248; 101/181

[58] Field of Search ..... 101/177, 179, 180, 181, 101/248; 226/2, 28; 318/77

[56] References Cited

U.S. PATENT DOCUMENTS

| | | | |
|---|---|---|---|
| 3,915,090 | 10/1975 | Horst et al. | 101/181 |
| 4,072,104 | 2/1978 | Schaffer | 101/248 |
| 4,271,379 | 6/1981 | Eckelmeyer | 318/77 |
| 4,781,317 | 11/1988 | Ditto | 226/27 |
| 4,785,734 | 11/1988 | Kamann | 101/181 |

*Primary Examiner*—David A. Wiecking
*Assistant Examiner*—Steven S. Kelley
*Attorney, Agent, or Firm*—Tarolli, Sundheim & Covell

[57] ABSTRACT

A plate cylinder of an offset printing press is adjustable. A motor has an output shaft operatively connected with the plate cylinder to, when driven, adjust the position of the plate cylinder. A tachometer provides a speed reference signal indicative of the rotational speed of the plate cylinder. A register mark error sensor provides an adjustment control signal indicating that the plate cylinder should be adjusted. A computer responds to the speed reference signal and the adjustment control signal to control a DC drive. The DC drive drives the motor at a speed which varies with the rotational speed of the plate cylinder. The plate cylinder is thereby moved to a desired position at a rate which is a function of the operating speed of the printing press. The plate cylinder is moved to the desired position at a slow rate when the printing press is operating at a slow speed and at a fast rate when the printing press is operating at a fast speed. By moving the plate cylinder to the desired position at a rate which varies with the operating speed of the printing press in this manner, the plate cylinder is adjusted a constant angular distance for each revolution of the plate cylinder.

6 Claims, 2 Drawing Sheets

ADJUSTMENT APPARATUS WITH DC DRIVE SYSTEM FOR USE IN A PRINTING PRESS

TECHNICAL FIELD

The present invention relates to adjustment of the position of a cylinder of a printing press, and particularly relates to an apparatus including an electric motor which, when actuated, adjusts the position of a plate cylinder of an offset printing press.

BACKGROUND ART

The use of an electric motor for adjusting a plate cylinder of an offset printing press is well known. Typically, a plate cylinder of a printing press is circumferentially adjusted, laterally adjusted, and/or phase adjusted. In a multi-unit printing press, a motor is associated with each plate cylinder to adjust the circumferential position of the plate cylinder, for example. The motors are controlled to adjust their respective plate cylinders at a constant rate.

Poor quality or doubling of a printed image on a web of sheet material may occur because of an adjustment of the plate cylinder by the prior known technique. Poor quality or doubling occurs because the amount of adjustment per unit of time, i.e. the rate of adjustment, of the plate cylinder is constant. Since the rate of adjustment of the plate cylinder is constant, the amount of adjustment per revolution of the plate cylinder is not constant but varies as a function of the rate of revolution, i.e. the rotational speed, of the plate cylinder.

For example, when a plate cylinder and a cooperating blanket cylinder in an offset printing press are rotating together at a fast rate, the amount of adjustment per revolution of the plate cylinder is relatively small. However, when the plate cylinder and the blanket cylinder are rotating together at a slow rate, the amount of adjustment per revolution of the plate cylinder is relatively large. When the amount of adjustment per revolution of the plate cylinder is relatively large, the plate cylinder could be advanced to an extent such that doubling occurs.

Doubling occurs because the blanket cylinder prints the same image onto a web of sheet material twice. One printing is due to the residual (leftover) ink of an image which is applied by the printing plate on the plate cylinder to one location on the blanket cylinder during one revolution of the blanket cylinder and remains on the blanket cylinder after the one revolution of the blanket cylinder. The other printing is due to ink of the same image which is applied by the printing plate on the plate cylinder to another location on the blanket cylinder after the one revolution of the blanket cylinder and after adjustment of the plate cylinder. The image on the web from the one printing and the image on the web from the other printing are offset from each other enough give the appearance of a double image, i.e. doubling of an image. When doubling occurs, poor quality and/or wasted paper results.

SUMMARY OF THE INVENTION

An apparatus is provided for adjusting the position of a cylinder of a printing press, for example, a plate cylinder of an offset printing press. The apparatus comprises a motor having an output shaft operatively connected with the cylinder to, when driven, adjust the position of the cylinder. Means is provided for providing a speed reference signal indicative of the operating speed of the printing press. Preferably, a tachometer is operatively connected with a drive shaft associated with the printing press to provide the speed reference signal. Means is provided for providing an adjustment control signal indicating that the cylinder should be adjusted. The means for providing the adjustment control signal may be a register mark error sensor, for example, or a manually operable push button. Motor control means responsive to the speed reference signal and the adjustment control signal is provided for driving the motor at a speed which varies with the rotational speed of the cylinder thereby moving the cylinder to a desired position at a rate which is a function of the operating speed of the printing press.

When the printing press is operating at a slow speed, the motor is driven at a relatively slow speed to move the cylinder to the desired position at a relatively slow rate. When the printing press is operating at a fast speed, the motor is driven at a relatively fast speed to move the cylinder to the desired position at a relatively fast rate. The cylinder is therefore moved to the desired position at a rate which is a function of the operating speed of the printing press.

By moving the cylinder to the desired position at a rate which is a function of the operating speed of the printing press in the manner described, poor quality images and/or doubling of images on a web of sheet material are minimized. Poor quality images and/or doubling of images on the web of sheet material are minimized because the amount of adjustment per revolution of the plate cylinder is constant. Thus, the plate cylinder moves slower to the desired position if the operating speed of the printing press is slower and moves faster to the desired position if the operating speed of the printing press is faster.

BRIEF DESCRIPTION OF THE DRAWINGS

The foregoing and other features and advantages of the present invention will become apparent to one skilled in the art to which the present invention relates from reading the following description of a preferred embodiment of the present invention in conjunction with the accompanying drawings, wherein.

DETAILED DESCRIPTION OF A PREFERRED EMBODIMENT

The present invention is directed to an apparatus for adjusting the position of a cylinder of a printing press during operation of the printing press. The present invention may be used in printing presses of different constructions. The description below is merely an example of one application of the present invention to one type of printing press.

Figure 1:
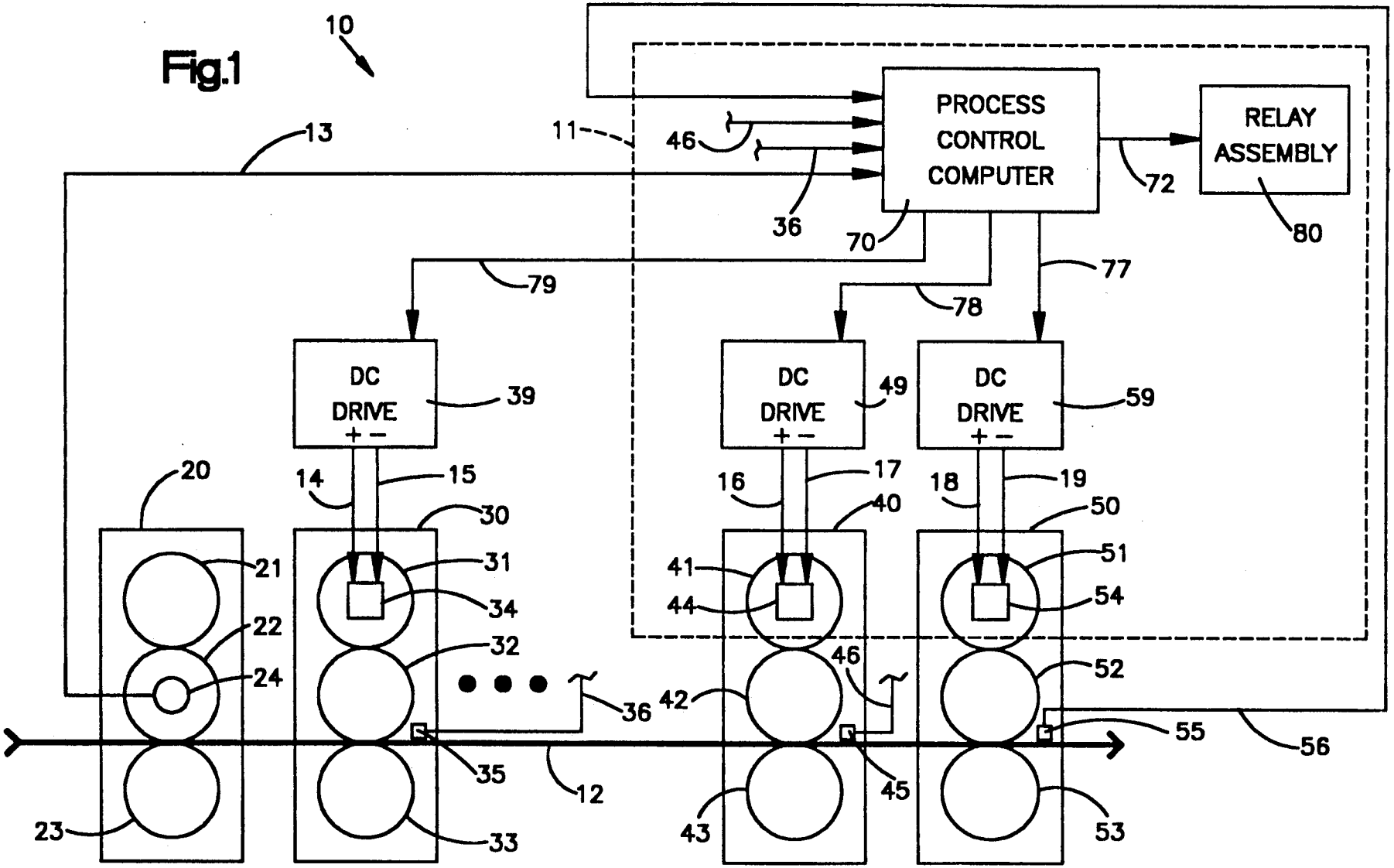
FIG. 1 is a schematic block diagram of a printing press incorporating a control apparatus constructed in accordance with the present invention.

Referring to FIG. 1, a printing press 10 has a number of printing units. As shown in FIG. 1, only four printing units 20, 30, 40, 50 are shown. Although only four printing units are shown in FIG. 1, it is understood that a different number of printing units may be incorporated into the printing press 10. The printing units 20, 30, 40, 50 have respective blanket cylinders 22, 32, 42, 52 which define respective nips with respective impression cylinders 23, 33, 43, 53. A web 12 of sheet material is directed through each nip defined by the blanket and impression cylinders as shown in FIG. 1. The printing units 20, 30, 40, 50 also have respective plate cylinders 21, 31, 41, 51 which carry respective printing plates (not shown). The printing plates apply respective images to be printed on the respective blanket cylinders 22, 32, 42, 52, as is known. The blanket cylinders 22, 32, 42, 52 print the respective images onto the web 12 of sheet material.

Each of the plate cylinders 21, 31, 41, 51 has a respective drive shaft (not shown) connected thereto. Also, each of the blanket cylinders 22, 32, 42, 52 has a respective drive shaft (not shown) connected thereto. Similarly, each of the impression cylinders 23, 33, 43, 53 has a respective drive shaft (not shown) connected thereto. The drive shaft of each of the plate cylinders 21, 31, 41, 51, the drive shaft of each of the respective blanket cylinders 22, 32, 42, 52, and the drive shaft of each of the respective impression cylinders 23, 33, 43, 53 are drivingly interconnected in a known manner. A common drive shaft (not shown) is drivingly connected to drive each of the drive shafts of the impression cylinders 23, 33, 43, 53. When the common drive shaft rotates, the impression cylinders 23, 33, 43, 53, the blanket cylinders 22, 32, 42, 52, and the plate cylinders 21, 31, 41, 51 all rotate in a known manner.

The printing unit 20 has a tachometer 24 to indicate the operating speed of the printing press 10. The tachometer 24 is shown operatively connected with the drive shaft of the blanket cylinder 22. However, the tachometer 24 could be mounted anywhere including on the common drive shaft for the printing units 20, 30, 40, 50. The tachometer 24 provides a control signal on line 13 indicative of the operating speed of the printing press 10. Each of the plate cylinders 21, 31, 41, 51 rotates at a speed functionally related to the operating speed of the printing press 10.

The printing units 30, 40, 50 have respective DC motors 34, 44, 54. Each of the DC motors 34, 44, 54 has an output shaft operatively associated with the corresponding one of the plate cylinders 31, 41, 51. Each of the DC motors 34, 44, 55, when energized, circumferentially adjusts the angular position of the corresponding one of the plate cylinders 31, 41, 51 relative to the corresponding one of the blanket cylinders 32, 42, 52.

The DC motors 34, 44, 54 are associated with the plate cylinders 31, 41, 51 in a known manner to effect angular adjustment of the respective plate cylinders 31, 41, 51 relative to the respective blanket cylinders 32, 42, 52. U.S. Pat. No. 4,072,104, entitled "Printing Unit Drive System", discloses a drive for enabling angular adjustment of a plate cylinder relative to a blanket cylinder which could be used in the printing press 10. U.S. Pat. No. 4,072,104 discloses a known drive interconnection which could be used to interconnect the DC motors 34, 44, 54 with the respective plate cylinders 31, 41, 51. Each of the DC motors 34, 44, 54 may be actuated in either direction for a predetermined time to adjust the angular position of the corresponding one of the plate cylinders 31, 41, 51 relative to the angular position of the corresponding one of the blanket cylinders 32, 42, 52. Thus, the plate cylinders 31, 41, 51 are circumferentially adjusted relative to their respective blanket cylinders 32, 42, 52 when the respective DC motors 34, 44, 54 are operated.

The printing press 10 includes a control system having some means for indicating the need for adjustment. In the illustrated embodiment, a sensor for sensing circumferential misregister is used. Specifically, the printing units 30, 40, 50 have respective register mark sensors 35, 45, 55 for sensing register marks printed onto the web 12 of sheet material, as is known. Each of the register mark sensors 35, 45, 55 provides a respective register mark error signal on a respective signal line. The register mark error signal from the register mark sensor 35 is on a signal line 36, the register mark error signal from the register mark sensor 45 is on a signal line 46, and the register mark error signal from the register mark sensor 55 is on a signal line 56.

All three signals on lines 36, 46, 56 are connected to a process control computer 70. As shown in FIG. 1, only the register mark error signal on line 56 is shown completely connected between the register mark sensor 55 and the computer 70. Although not shown in FIG. 1, it is understood that the register mark error signals from other register mark sensors including the register mark sensors 36, 46 are connected to the computer 70 in the same manner that the register mark error signal on line 56 from the register mark sensor 55 is connected to the computer 70.

The printing units 30, 40, 50 have respective DC drives 39, 49, 59. Each of the DC drives 39, 49, 59 has a pair of DC output power lines connectable with the corresponding one of the DC motors 34, 44, 54. A pair of DC output power lines 14, 15 is connectable with the motor 34. A pair of DC output power lines 16, 17 is connectable with the motor 44. A pair of DC output power lines 18, 19 is connectable with the motor 54. The computer 70 provides a speed control signal on signal line 77 to the DC drive 59 to control the application of the DC output power to power lines 18, 19. Similarly, the computer 70 provides a speed control signal on signal line 78 to the DC drive 49 to control the application of the DC output power to power lines 16, 17. Also, the computer 70 provides a speed control signal on signal line 79 to the DC drive 39 to control the application of the DC output power to power lines 14, 15.

Figure 2:
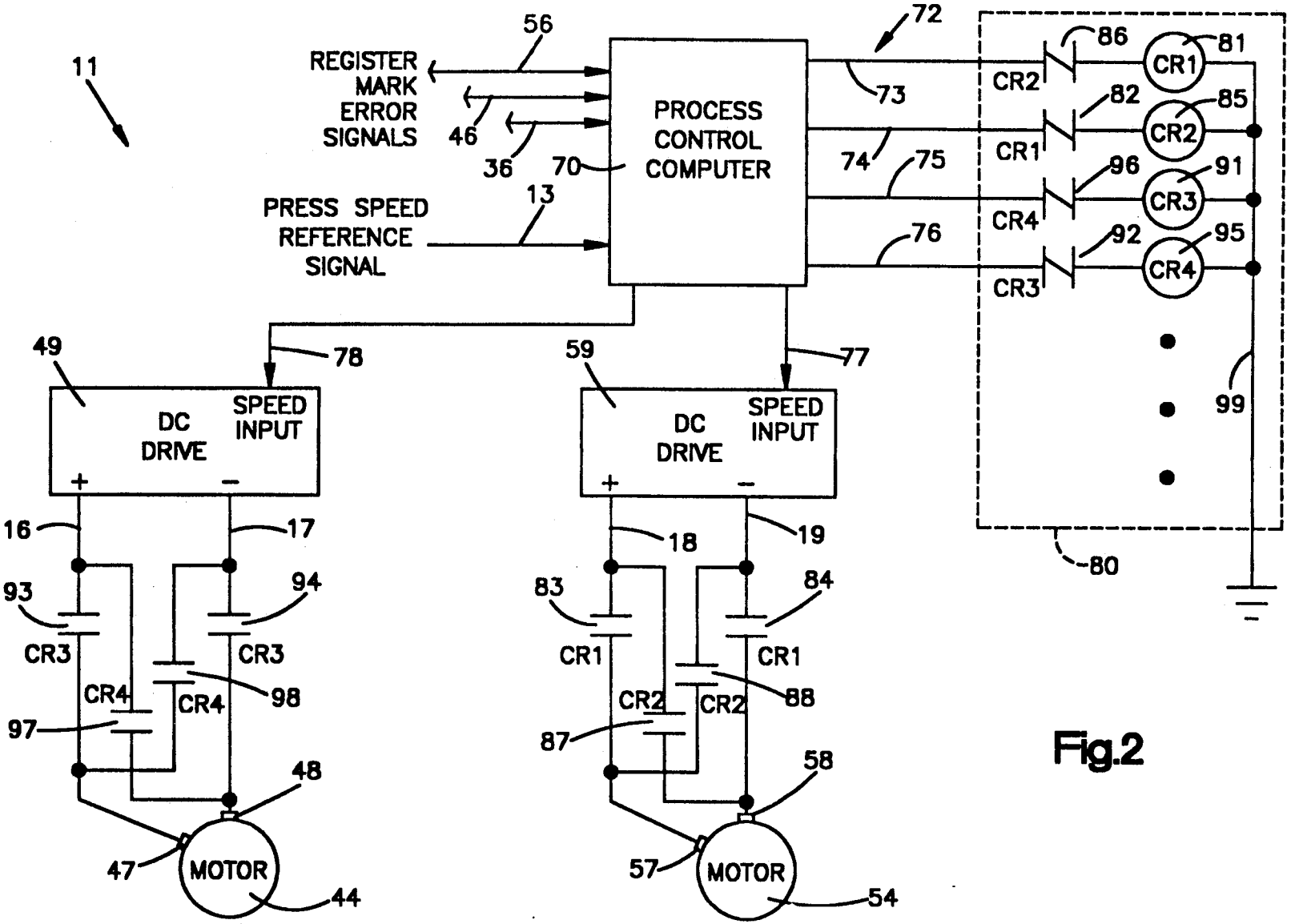
FIG. 2 is a detailed view of a portion of the control apparatus of FIG. 1.

The computer 70 also provides control signals on signal line 72 to a relay assembly 80. Referring to FIG. 2, the relay assembly 80 has a number of energizeable relays which are energized and deenergized in response to the control signals on line 72 from the computer 70. As shown in FIG. 2, only four relays 81, 85, 91, 95 are shown. Two relays are associated with controlling each DC motor. The two relays 81, 85 are associated with controlling the motor 54 and the two relays 91, 95 are associated with controlling the motor 44. Although only four relays are shown in FIG. 1, it is understood that the number of relays needed depends upon the number of DC motors used in the printing press 10.

The computer 70 receives input signals and processes the input signals in accordance with a preprogrammed procedure stored in the internal memory of the computer 70. As shown in FIG. 1, the control signals on lines 77, 78, 79 and the control signals on line 72 are generated in accordance with a preprogrammed procedure stored in the internal memory of the computer 70 in response to the signal on line 13 from the tachometer 24 and the signals on lines 36, 46, 56 from the register mark sensors 35, 45, 55. Computers are readily available in the commercial market. Their internal structure and operation are well known in the art and, therefore, the computer 70 will not be described in detail herein.

Referring to FIG. 2, the signal line 72 includes a signal line 73 connected between the computer 70 and one side of a normally-closed contact set 86 of the relay 85 (CR2). The signal line 72 also includes a signal line 74 connected to one side of a normally-closed contact set 82 of the relay 81 (CR1). The signal line 72 also includes a signal line 75 connected between the computer 70 and one side of a normally-closed contact set 96 of the relay 95 (CR4). A signal line 76 is connected between the computer 70 and one side of a normally-closed contact set 92 of the relay 91 (CR3).

Each of the relays 81, 85, 91, 95 has one coil terminal connected to ground on line 99. The other coil terminal of the relay 81 is connected to the other side of the contact set 86 of the relay 85. The other coil terminal of the relay 85 is connected to the other side of the contact set 82 of the relay 81. The other terminal of the relay 91 is connected to the other side of the contact set 96 of the relay 95. The other terminal of the relay 95 is connected to the other side of the contact set 92 of the relay 91.

A contact set 83 and a contact set 84 are associated with the relay 81. A contact set 87 and a contact set 88 are associated with the relay 85. A contact set 93 and a contact set 94 are associated with the relay 91. A contact set 97 and a contact set 98 are associated with the relay 95. The structure operation of the pair of relays 91, 95 are the same as that of the pair of relays 81, 85. Since the structure and operation of the relays 91, 95 are the same as that of the relays 81, 85, only the structure and operation of the relays 81, 85 associated with the motor 54 will be described in detail.

One side of the contact set 83 is connected to the power on line 18 and the other side of the contact set 83 is connected to a terminal 57 of the motor 54. One side of the contact set 84 is connected to the power on line 19 and the other side of the contact set 84 is connected to a terminal 58 of the motor 54. One side of the contact set 87 is connected to the power on line 18 and the other side of the contact set 87 is connected to the terminal 58 of the motor 54. One side of the contact set 88 is connected to the power line 19 and the other side of the contact set 88 is connected to the terminal 57 of the motor 54.

The contact sets 82, 83, 84 associated with the relay 81 and the contact sets 86, 87, 88 associated with the relay 85 are arranged and interconnected so that the energization of either the relay 81 or the relay 85 prevents energization of the other relay not energized. For example, if a signal is on line 73 which energizes the relay 81, the contact set 82 opens so that the relay 85 cannot be energized. Similarly, if a signal is on line 74 which energizes the relay 85, the contact set 86 opens so that the relay 81 cannot be energized.

When the relay 81 is energized, the contact sets 83, 84 are closed and the contact sets 87, 88 are open. When the contact sets 83, 84 of the relay 81 are closed, the motor 54 operates so that its output shaft rotates in one direction. When the relay 85 is energized, the contact sets 87, 88 are closed and the contact sets 83 and 84 are open. When the contact sets 86, 87 of the relay 85 are closed, the motor 54 operates so that its output shaft rotates in the opposite direction.

The computer 70 monitors the signal on line 13 from the tachometer 24 and the signals on lines 36, 46, 56 from the register mark sensors 35, 45, 55. The computer 70 generates the control signals on lines 77, 78, 79 to control the DC drives 39, 49, 59 in response to the signal on line 13 from the tachometer 24 and the signals on lines 36, 46, 56 from the register mark sensors 35, 45, 55. The computer 70 also generates the control signals on line 72 to control relays in the relay assembly 80.

With specific regard to operation of the motor 54, the control signal on line 73 and the control signal on line 74 are provided by the computer 70 in response to the signal on line 13 from the tachometer 24 and the signals on lines 36, 46, 56 from the register mark sensors 35, 45, 55. As previously mentioned, the computer 70 also generates the speed control signal on line 77 in response to the signal on line 13 and the signals on lines 36, 46, 56. The DC drive 59 applies the DC output power on lines 18, 19 in accordance with the control signal on line 77. The DC output power on lines 18, 19 varies as a function of the operating speed of the printing press 10 as indicated on line 13 and the register mark error signals as indicated on lines 36, 46, 56.

Since the DC output power applied on lines 18, 19 varies as a function of the operating speed of the printing press 10, the motor 54 is driven at a speed which varies with the operating speed of the printing press. The plate cylinder 51 is thereby rotated to a desired position and relative to the blanket cylinder 52 at a slow rate when the printing press 10 is operating at a slow speed and at a fast rate when the printing press 10 is operating at a fast speed. Thus, the plate cylinder 51 is adjusted at a rate which varies with the operating speed of the printing press 10. Specifically, the plate cylinder 51 is adjusted a constant angular distance for each revolution of the plate cylinder 51.

By adjusting the position of the plate cylinder 51 at a rate which varies with the operating speed of the printing press and particularly a constant distance on each revolution of the plate cylinder 51, poor quality and/or doubling of a printed image on the web 12 of sheet material is minimized. Poor quality images and/or doubling of images on the web 12 of sheet material are minimized because the amount of adjustment per revolution of the plate cylinder 51 is constant and does not depend upon the rotational speed of the plate cylinder 51. The amount of adjustment per revolution of the plate cylinder 51 is constant and independent of the rotational speed of the plate cylinder 51 because the plate cylinder 51 moves slower to the desired position if the operating speed of the printing press 10 is slower and moves faster to the desired position if the operating speed of the printing press 10 is faster.

The structure and operation of the DC motor 44 are the same as the structure and the operation of the DC motor 54. Also, as already mentioned hereinabove, the structure and operation of the relay 91 and its associated contact sets 92, 93, 94 are the same as the structure and operation of the relay 81 and its associated contact sets 82, 83, 84. The structure and operation of the relay 95 and its associated contact sets 96, 97, 98 are the same as the structure and operation of the relay 85 and its associated contact sets 86, 87, 88. The DC output power on lines 16, 17 is applied to the motor 44 in the same manner as the DC output power on lines 18, 19 is applied to the motor 54.

When the DC output power on lines 16, 17 is applied to the motor 44, the motor 44 is driven at a speed which varies with the operating speed of the printing press 10 in the same manner that the motor 54 is driven at a speed which varies with the operating speed of the printing press 10. The motor 44 also moves the plate cylinder 41 to a desired position and relative to the blanket cylinder 42 at a rate which varies with the operation speed of the printing press 10. Thus, the plate cylinder 41 also is adjusted at a rate which varies with the operating speed of the printing press 10.

Although the plate cylinders 41, 51 are described hereinabove as being circumferentially adjusted relative to their respective blanket cylinders 42, 52, it is contemplated that the plate cylinders 41. 51 could be laterally adjusted, phase adjusted, or adjusted in other ways by the same type of control system as described hereinabove.

It is also contemplated that it may be desirable in some situations to energize all DC motors at one time or a plurality of DC motors at one time. The energization of all DC motors at one time may be accomplished by programming the computer 70 so that all relays in the relay assembly 80 associated with allowing all DC motors to operate in one direction are energized in response to certain signals. The energization of only certain DC motors at one same time may be accomplished by programming the computer 70 so that only certain relays in the relay assembly 80 associated with allowing the certain DC motors to operate in one direction are energized. Only those DC motors associated with the certain energized relays will be energized.

Further, it is contemplated that it may be desirable to include provisions to permit a person to manually press a button to select operation of any one or all of the DC motors as the person sees fit.

This invention has been described with reference to a preferred embodiment. Modifications and alternations may become apparent to one skilled in the art upon reading and understanding the specification. It is intended to include all such modifications and alterations within the scope of the appended claims.

Having described a specific embodiment of the present invention the following is claimed:

1. An apparatus for adjusting the position of a plate cylinder of an offset printing press, said apparatus comprising:

a first motor having an output shaft operatively connected with the cylinder to, when driven, adjust the circumferential position of the cylinder;

means for providing a speed reference signal indicative of the rotational speed of the cylinder;

means for providing an adjustment control signal indicating that the cylinder should be adjusted; and motor control means responsive to said speed reference signal and said adjustment control signal for driving said first motor at a speed which varies proportional to the rotational speed of the cylinder thereby moving the cylinder to a desired position at a rate which is a function of the operating speed of the printing press, said motor control means controlling said first motor to provide a constant amount of adjustment of the plate cylinder per revolution of the plate cylinder.

2. An apparatus as defined in claim 1 wherein said means for providing said adjustment control signal is a register mark sensor.

3. An apparatus as defined in claim 1 wherein the cylinder is a plate cylinder of an offset printing press and further comprising a second motor having an output shaft operatively connected with another plate cylinder to, when driven, adjust the position of the another plate cylinder, means for providing a speed reference signal indicative of the rotational speed of the another plate cylinder, and means for providing an adjustment control signal indicating that the another plate cylinder should be adjusted, said motor control means being responsive to said speed reference signal of the another plate cylinder and said adjustment control signal of the another plate cylinder for driving said second motor at a speed which varies with the rotational speed of the another plate cylinder thereby moving the another plate cylinder to a desired position at a rate which is a function of the operating speed of the printing press.

4. An apparatus as defined in claim 3 wherein said motor control means includes a DC drive and relay logic means which controls application of DC output power from said DC drive to said first and said second motors.

5. An apparatus as defined in claim 4 wherein said motor control means includes a computer which controls said DC drive in response to said speed reference signals and said adjustment control signals.

6. An apparatus as defined in claim 1 wherein said means for providing said speed reference signal is a tachometer operatively connected to the printing press.

* * * * *

UNITED STATES PATENT AND TRADEMARK OFFICE

CERTIFICATE OF CORRECTION

PATENT NO. : 5,127,324

DATED : July 7, 1992

INVENTOR(S) : Roland T. Palmatier and Glenn A. Guaraldi

It is certified that error appears in the above-identified patent and that said Letters Patent is hereby corrected as shown below:

Title page, item [75] Inventors: change "Ronald" to --Roland--.

Signed and Sealed this

Fifth Day of October, 1993

Bruce Lehman

*Attest:*

BRUCE LEHMAN

*Attesting Officer*

*Commissioner of Patents and Trademarks*